US005380176A

United States Patent [19]

Kikuchi et al.

[11] Patent Number: 5,380,176

[45] Date of Patent: Jan. 10, 1995

[54] VALVED DISCHARGE MECHANISM IN A REFRIGERANT COMPRESSOR

[75] Inventors: Yasuo Kikuchi; Atsushi Mabe; Kiyoshi Terauchi, all of Isesaki, Japan

[73] Assignee: Sanden Corporation, Isesaki, Japan

[21] Appl. No.: 124,619

[22] Filed: Sep. 21, 1993

[30] Foreign Application Priority Data

Sep. 21, 1992 [JP] Japan ..... 4-274846

[51] Int. Cl.[6] ..... F04C 29/00; F16K 15/16

[52] U.S. Cl. ..... 418/55.1; 418/270; 137/856

[58] Field of Search ..... 418/55.1, 270; 137/855, 137/856

[56] References Cited

U.S. PATENT DOCUMENTS

| | | | |
|---|---|---|---|
| 2,647,683 | 8/1953 | Schweller . | |
| 4,011,029 | 3/1977 | Shimizu | 417/269 |
| 4,444,219 | 4/1984 | Hollenstein | 137/856 |
| 4,642,037 | 2/1987 | Fritchman | 137/856 |
| 4,978,285 | 12/1990 | Da Costa | 137/856 |
| 5,203,686 | 4/1993 | Scheldorf et al. | 418/270 |

FOREIGN PATENT DOCUMENTS

| | | | |
|---|---|---|---|
| 1214370 | 11/1959 | France . | |
| 52-71732 | 6/1977 | Japan | 137/856 |
| 55-163375 | 12/1980 | Japan | 137/856 |
| 60-145481 | 7/1985 | Japan | 418/270 |
| 650642 | 2/1951 | United Kingdom | 137/856 |

*Primary Examiner*—John J. Vrablik
*Attorney, Agent, or Firm*—Baker & Botts

[57] ABSTRACT

A refrigerant compressor includes a compressor housing defining a chamber in which successive strokes of intake, compression, and discharge of a refrigerant gas are repeatedly performed. The chamber is divided into a compression chamber and a discharge chamber by a valve plate. A discharge hole links the compression chamber to the discharge chamber. The valve plate includes an end surface which faces the discharge chamber. A discharge valve regulates a flow of the refrigerant gas from the compression chamber to the discharge chamber. A valve retainer limits the bending movement of the discharge valve in the direction in which the refrigerant gas exits the discharge hole. The valve retainer is secured to an axial end surface of the valve plate together with the discharge valve by a fixing bolt. The discharge valve bends as it opens and closes the discharge hole. The valve plate includes an annular groove formed at the end surface thereof. The annular groove surrounds the discharge hole and is entirely overlaid by the discharge valve. Also, an air gap may be formed between the discharge valve and the valve plate. Thereby, noise due to resonant vibration caused by the discharge valve can be effectively reduced or eliminated.

10 Claims, 8 Drawing Sheets

VALVED DISCHARGE MECHANISM IN A REFRIGERANT COMPRESSOR

BACKGROUND OF THE INVENTION

1. Field of the Invention

The present invention generally relates to a refrigerant compressor and, more particularly, to a valved discharge mechanism of a refrigerant compressor suitable for use in an automotive air conditioning system.

2. Description of the Prior Art

The valved discharge mechanism in a refrigerant compressor is well known in the prior art. For example, FIGS. 2 and 3 depict a valved discharge mechanism in a refrigerant compressor as disclosed in U.S. Pat. No. 4,815,952. As disclosed therein, a refrigerant compressor includes a compressor housing defining a compression chamber in which successive strokes of intake, compression, and discharge of a refrigerant gas are repeatedly performed. Further, the compressor includes valve plate 241 which is formed to partition a compression chamber and a discharge chamber and a discharge valve assembly which is mounted on an upper surface of valve plate 241. Valve plate 241 has discharge hole 244 extending therethrough for communicating the compression chamber with the discharge chamber. The discharge valve assembly includes discharge reed valve 249 and valve retainer 250 which are secured together to the upper surface of valve plate 241 by fixing bolt 255. Valve seat 241*a* is integrally formed in the upper surface of valve plate 241 around discharge hole 244. Discharge reed valve 249, which is made of an elastic material, regulates a flow of the refrigerant gas and is in sealing contact against valve seat 241*a* without an air gap when operation of the compressor is stopped.

Valve retainer 250 limits the bending movement of discharge reed valve 249 in the direction in which the refrigerant gas exits discharge hole 244. Discharge reed valve 249 bends as it opens and closes discharge hole 244 and has a spring constant which allows discharge reed valve 249 to block discharge hole 244 until the pressure in the compression chamber reaches a predetermined value.

Spiral elements 242, 252 are disposed within the compressor housing and interfit with an angular and radial offset. At least one pair of fluid pockets are thereby defined between spiral elements 242, 252.

The air gap between discharge reed valve 249 and the upper surface of valve seat 241*a* is increased and decreased in accordance with the velocity of the refrigerant gas exhausted from the discharge chamber through discharge hole 244. The discharge velocity varies according to the rotational speed of the compressor. It will be appreciated by those skilled in the art that compressed air in the fluid pockets is intermittently delivered to a central fluid pocket. This, in turn, leads to pulsed fluid delivery through discharge hole 244. As compressed refrigerant gas is discharged through discharge hole 244, a resulting Karman vortex street causes vibration of the compressed refrigerant gas. When the magnitude vibration of the compressed refrigerant gas reaches a frequency band of approximately 10–14kHz, the air gap, which is formed as a column of air, produces a resonant vibration due to sympathizing with the vibration of the compressed refrigerant gas. As a result, an offensive noise propagates to the passenger compartment of the vehicle.

SUMMARY OF THE INVENTION

It is an object of the present invention to provide a refrigerant compressor suitable for use in an automotive air conditioning system having a valved discharge mechanism which can effectively reduce the vibration caused by a discharge valve assembly and, thus, reduce the propagation of an offensive noise to a passenger compartment of a vehicle.

It is a further object of the present invention to provide a refrigerant compressor having a valved discharge mechanism wherein the life of a discharge reed valve is prolonged.

According to the present invention, a refrigerant compressor includes a compressor housing defining a chamber in which successive strokes of intake, compression, and discharge of a refrigerant gas are repeatedly performed. The chamber is divided into a compression chamber and a discharge chamber by a valve plate. A discharge hole links the compression chamber to the discharge chamber. The valve plate includes an end surface which faces the discharge chamber. A discharge valve regulates the flow of refrigerant gas from the compression chamber to the discharge chamber. The discharge valve is made of an elastic material. A valve retainer limits the bending movement of the discharge valve in the direction in which the refrigerant gas exits the discharge hole. The valve retainer is secured to the axial end surface of the valve plate together with the discharge valve by a fixing bolt. The discharge valve bends as it opens and closes the discharge hole. The discharge valve has a spring constant which allows the discharge valve to block the discharge hole until a pressure in the compression chamber reaches a predetermined value.

The valve plate includes an annular groove formed at the end surface thereof. The annular groove surrounds the discharge hole and is entirely overlaid by the discharge reed valve. Also, an air gap may be formed between the discharge reed valve and the valve plate. The annular groove and air gap reduce the magnitude of the resonant vibrations, thereby reducing or eliminating noise propogated to the passenger compartment of the vehicle.

Further objects, features and advantages of the present invention will be understood from the detailed description of the preferred embodiments of the present invention with reference to the appropriate figures.

DETAILED DESCRIPTION OF THE PREFERRED EMBODIMENTS

Figure 1:
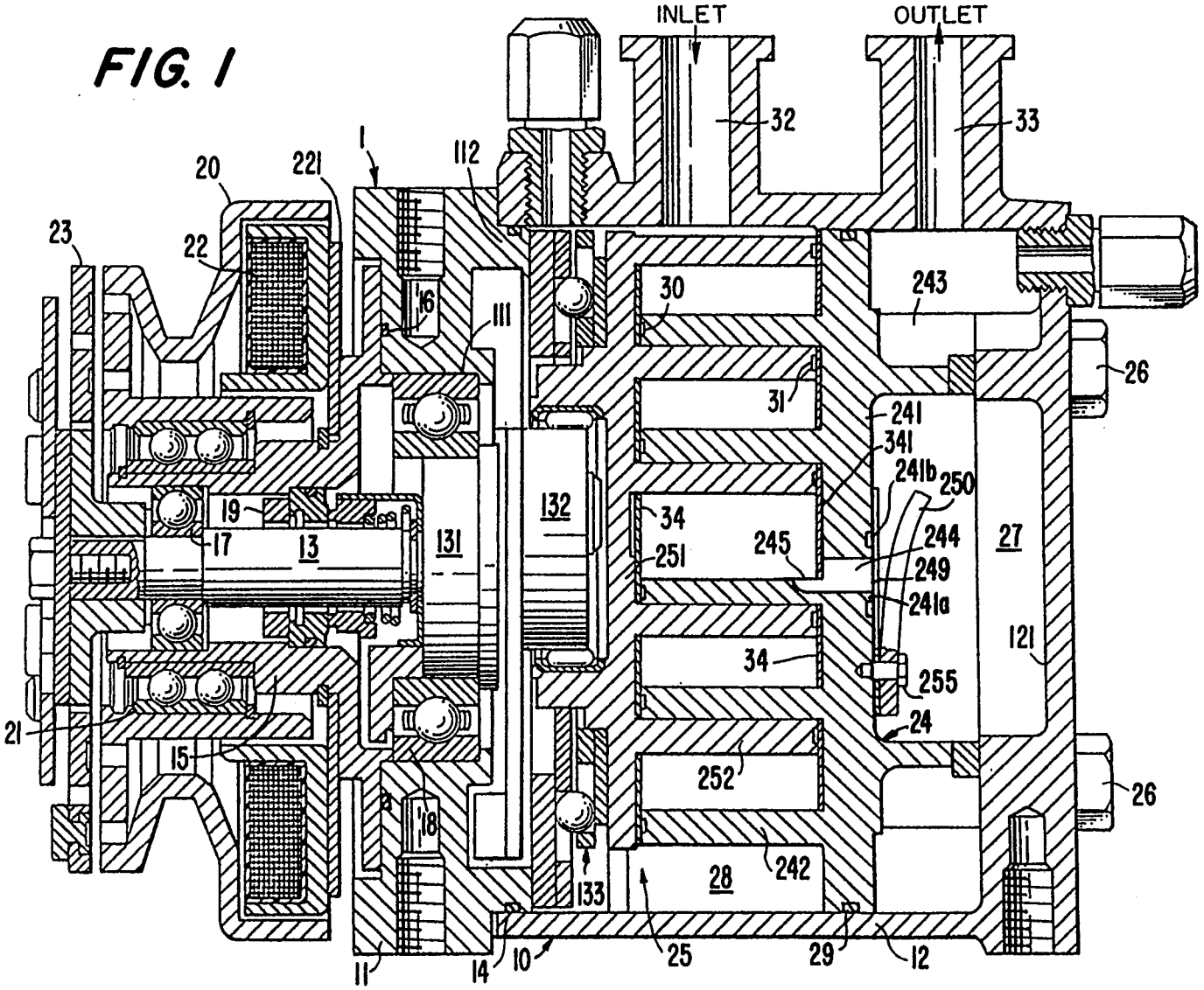
FIG. 1 is a longitudinal sectional view of a scroll-type refrigerant compressor in accordance with the present invention.
Figure 2:
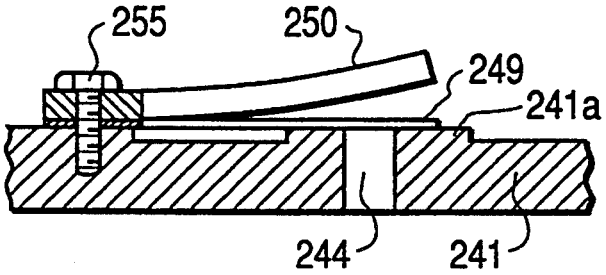
FIG. 2 PRIOR ART
FIG. 2 is a sectional view of a discharge valve assembly in accordance with the prior art.
Figure 3:
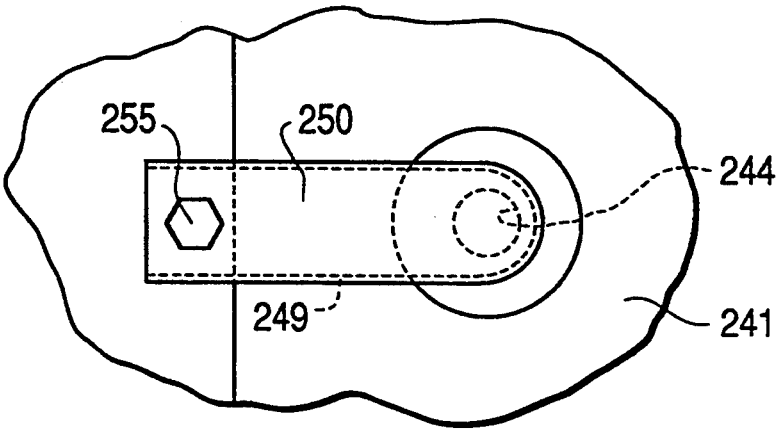
FIG. 3 PRIOR ART
FIG. 3 is a plan view of the discharge valve assembly depicted in FIG. 2.

FIG. 1 depicts a refrigerant compressor, in particular a scroll-type compressor, in accordance with the present invention. Without limiting the preferred embodiments, the left side of FIG. 1 is referred to as the front and the right side of FIG. 1 is referred to as the rear. Compressor 1 includes housing 10 comprising from end plate member 11 and cup-shaped casing 12 which is disposed on a rear end surface of front end plate member 11. Opening 111 is formed in a center of front end plate member 11 for penetration of drive shaft 13. Annular projection 112 is formed on the rear end surface of front end plate member 11 and faces cup-shaped casing 12. An outer peripheral surface of annular projection 112 fits into an inner wall surface of an opening portion of cup-shaped casing 12. Cup-shaped casing 12 is fixed on the rear end surface of front end plate member 11 by fastening means, e.g. bolts (not shown), so that the opening portion of cup-shaped casing 12 is covered by front end plate member 11. First O-ring member 14 is disposed between the outer peripheral surface of annular projection 112 and the inner wall surface of cup-shaped casing 12, to thereby effect a seal between the surfaces of from end plate member 11 and cup-shaped casing 12.

Front end plate member 11 has annular sleeve portion 15 projecting from a front end surface thereof for surrounding drive shaft 13 to define a shaft seal cavity. In this embodiment, annular sleeve portion 15 is separate from front end plate member 11. Therefore, annular sleeve portion 15 is fixed to the front end surface of front end plate member 11 by a plurality of fasteners, e.g. screws (not shown). Second O-ring member 16 is disposed between the front end surface of front end plate member 11 and annular sleeve portion 15. Alternatively, annular sleeve portion 15 may be formed integral with front end plate member 11. Drive shaft 13 is rotatably supported by annular sleeve portion 15 through bearing 17 disposed within a front end portion of annular sleeve portion 15. Disk portion 131 is formed at an inner end portion of drive shaft 13. Disk portion 131 is rotatably supported by front end plate member 11 through bearing 18 disposed within opening 111 of front end plate member 11. Shaft seal assembly 19 is assembled on drive shaft 13 within the shaft seal cavity of annular sleeve portion 15. Pulley 20 is rotatably supported by annular sleeve portion 15 through bearing 21 which is disposed on an outer surface of annular sleeve portion 15. Electromagnetic coil 22 is fixed on the outer surface of annular sleeve portion 15 by support plate 221 and is received in an annular cavity of pulley 20. Armature plate 23 is elastically supported on an outer end portion of drive shaft 13 which extends from annular sleeve portion 15. A magnetic clutch comprising pulley 20, electromagnetic coil 22, and armature plate 23 is thereby formed.

Drive shaft 13 is driven by an external power source, e.g. the engine of an automobile, through force transmitting means, such as the magnetic clutch. Fixed scroll member 24, orbiting scroll member 25, crank-type driving mechanism 132 of orbiting scroll member 25, and rotation preventing mechanism 133 of orbiting scroll member 25 are disposed in an inner chamber of cup-shaped casing 12. Fixed scroll member 24 includes second circular end plate 241, second spiral element 242 affixed to and extending from a front side surface of second circular end plate 241, and a plurality of internally threaded bosses 243 projecting axially from a rear end surface of second circular end plate 241. An end surface of each boss 243 is seated on an inner surface of end plate portion 121 of cup-shaped casing 12 and is fixed to end plate portion 121 by bolts 26.

Thus, fixed scroll member 24 is fixedly disposed within cup-shaped casing 12. Second circular end plate 241 of fixed scroll member 24 partitions the inner chamber of cup-shaped casing 12 into discharge chamber 27 and suction chamber 28 by seal ring 29 disposed between an outer peripheral surface of second circular end plate 241 and the inner wall surface of cup-shaped casing 12. Orbiting scroll member 25 is disposed within suction chamber 28 and comprises first circular end plate 251 and first spiral element 252 affixed to and extending from a rear side surface of first circular end plate 251. First spiral element 252 and second spiral element 242 of fixed scroll member 24 interfit with an angular and radial offset. At least one pair of fluid pockets are thereby defined between spiral elements 242, 252. Orbiting scroll member 25 is connected to crank-type driving mechanism 132 and rotation preventing mechanism 133, which effect orbital radius $R_o$ (not shown) by rotation of drive shaft 13, to thereby compress fluid passing through compressor 1. Each spiral element 242, 252 is provided with groove 30 formed on an axial end surface thereof. Seal element 31 is loosely fitted within groove 30. Sealing between the axial end surface of each spiral element 242, 252 and a respective end surface of an opposite end plate is effected by seal element 31.

As described above, when orbiting scroll member 25 orbits by the rotation of drive shaft 13, line contacts between spiral elements 242, 252 shift along spiral curved surfaces of spiral elements 242, 252 so that the fluid pockets move to the center of spiral elements 242, 252.

Therefore, fluid or refrigerant gas, introduced into suction chamber 28 from an external fluid circuit through inlet port 32 on cup-shaped casing 12, is drawn into the fluid pockets formed between spiral elements 242, 252. As orbiting scroll member 25 orbits, fluid in the fluid pockets is moved to the center of spiral elements 242, 252 with a consequent reduction of the volume of the fluid. Compressed fluid is discharged into discharge chamber 27 from the fluid pockets at the center of spiral elements 242, 252 through discharge hole 244, which is formed through second circular end plate 241 of fixed scroll member 24 at a position near the center of spiral element 242. The compressed fluid is discharged from discharge chamber 27 through outlet port 33 formed on cup-shaped casing 12 to an external fluid circuit, e.g. a cooling circuit.

Figure 4:
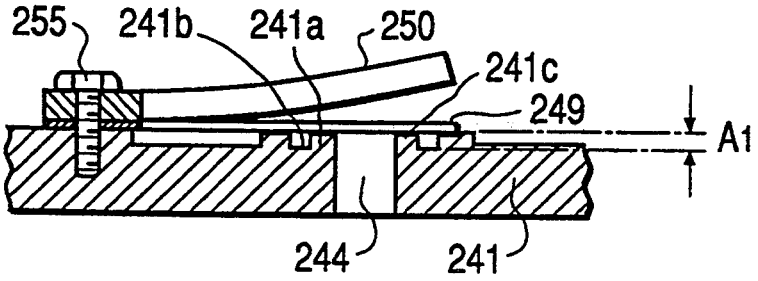
FIG. 4 is a sectional view of a discharge valve assembly in accordance with a first embodiment of the present invention.
Figure 5:
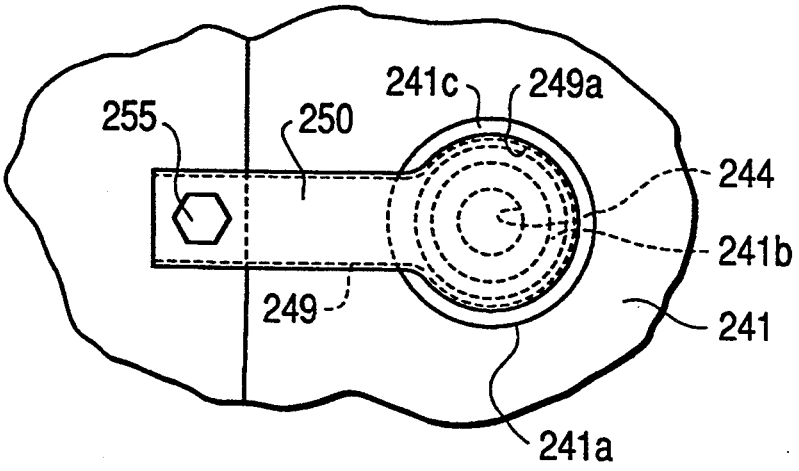
FIG. 5 is a plan view of the discharge valve assembly in accordance with the first embodiment of the present invention as depicted in FIG. 4.

In a first embodiment of the present invention, as depicted in FIGS. 4 and 5 in addition to FIG. 1, a discharge valve assembly is provided within discharge chamber 27. The discharge valve assembly includes discharge reed valve 249 and valve retainer 250 which are secured together to axial end surface 241*c* of second circular end plate 241 by fixing bolt 255. Second circular end plate 241 includes valve seat 241*a* which is formed in axial end surface 241*c* around discharge hole 244 and annular groove 241*b* which is formed in axial end surface 241*c* within valve seat 241*a*. Annular groove 241*b* is concentric with discharge hole 244. Discharge reed valve 249 which is made of an elastic material, e.g. thin spring steel, regulates a flow of the refrigerant gas and is in sealing contact with valve seat 241*a*. Valve retainer 250 limits the bending movement of discharge reed valve 249 in the direction which the refrigerant gas exits discharge hole 244. Discharge reed valve 249 bends as it opens and closes discharge hole 244 and has a spring constant which allows discharge reed valve 249 to block discharge hole 244 until a pressure in compression chamber 27 reaches a predetermined value. Further, discharge reed valve 249 includes end portion 249*a* which is dimensioned to be larger than the outer diameter of annular groove 241*b* so as to entirely cover annular groove 241*b*.

A discharge valve as disclosed in the prior art produces noise in accordance with the following description. In general, when a fluid is forcibly expelled from an opening of a tube, a Karman vortex street is caused at a border region of the circumferential medium. Therefore, a refrigerant gas which flows from a discharge hole to a discharge chamber causes a Karman vortex street near an opening of the peripheral edge of the discharge hole. Vibration of the refrigerant gas occurs with a specified frequency band due to the Karman vortex street. This frequency band can be represented by the following equation.

$$f = St \cdot V/D \qquad \text{Equation (1)}$$

In this formula, f is the frequency of a vibration and St is a Strouhal number which is related to a Reynolds number. V is the velocity of a medium, such as the refrigerant gas, and D is the diameter of an opening through which the medium flows. Further, an air gap between a discharge valve and a valve seat is formed as a column of air which has a natural frequency represented by the following equation.

$$fn = n \cdot A/2L \qquad \text{Equation (2)}$$

In this formula, fn is an nth order frequency and A is the speed of sound in a fluid gas. L is a length of a column of air. The natural frequency is only related to length L, not to the diameter of the column of air.

Figure 9:
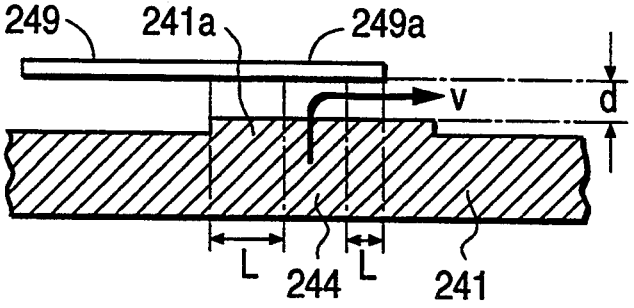
FIG. 9 PRIOR ART
FIG. 9 is a detailed sectional view of the discharge valve assembly as depicted in FIG. 2.
Figure 10:
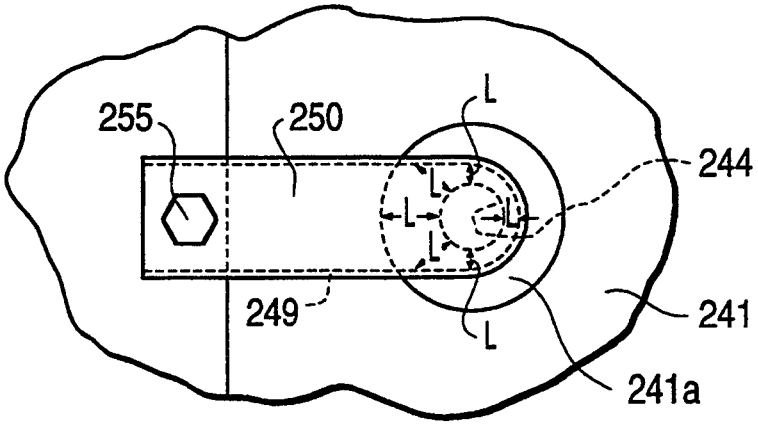
FIG. 10 PRIOR ART
FIG. 10 is a plan view of the discharge valve assembly as depicted in FIG. 9.

Referring to FIGS. 9 and 10, in accordance with the prior art, velocity v of the refrigerant gas from discharge hole 244 to discharge chamber 27 through discharge reed valve 249 increases in proportion to a rotational speed of compressor 1. Air gap d between discharge reed valve 249 and valve seat 241*a* is increased as discharge reed valve 249 is lifted and opened by discharged refrigerant gas. Length L is the length of discharge reed valve 249 as geometrically projected onto valve seat 241*a* and changes as discharge reed vane 249 is opened and closed.

Figure 11:
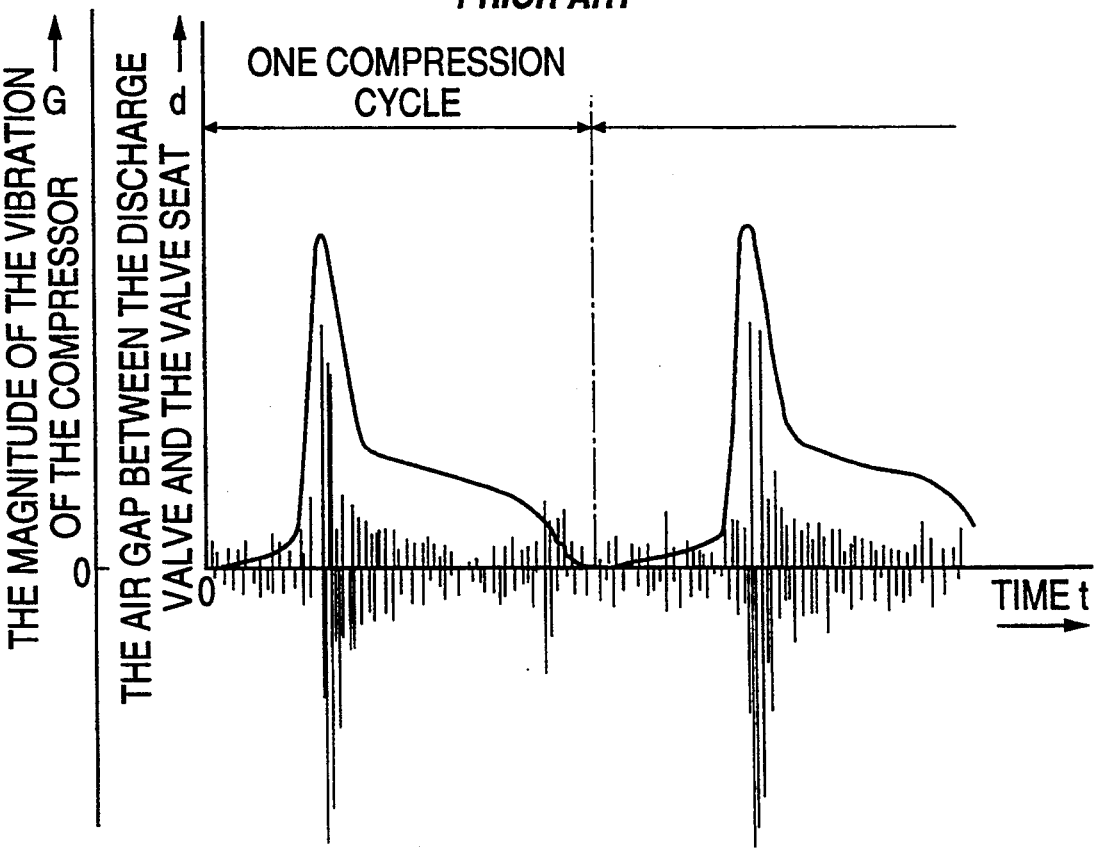
FIG. 11 PRIOR ART
FIG. 11 is graphical illustration of the relationship between air gap d, as depicted in FIG. 9, and time t, and a graphical illustration of the relationship between magnitude G of a vibration of a compressor, in accordance with the prior art, and time t.
Figure 12:
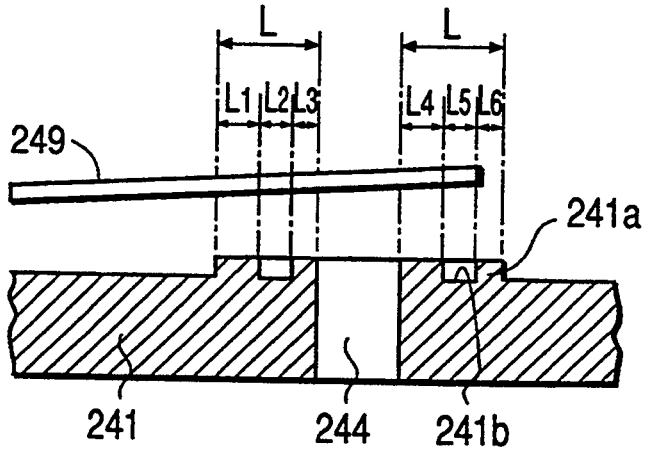
FIG. 12 is a detailed sectional view of the discharge valve assembly as depicted in FIG. 4.

Therefore, the above-described column of air produces a resonant vibration due to sympathizing with the vibration of the refrigerant gas which is caused by the Karman vortex street in accordance with Equations 1 and 2. Vibrations of various frequencies are caused at the same time because length L varies in all radial directions, and resonant vibration is caused at the peak of the movement locus of discharge reed valve 249 as illustrated in FIG. 11. FIG. 11 illustrates the displacement of air gap d related to time t. Moreover, the magnitude of the vibration becomes particularly large when discharge reed valve 249 reaches the peak of the movement locus and the noise caused by this peak vibration becomes particularly great when the vibration occurs at a frequency band of approximately 10–Hz. Referring to FIG. 12 in accordance with the first embodiment of the present invention, resonant vibrations occur at relatively high frequencies because length L of the column of air is divided into shorter lengths $L_1$, $L_2$, $L_3$, $L_4$, $L_5$, $L_6$. These relatively high frequencies are beyond the limits of auditory sensation. As a result, noise due to resonant vibration is eliminated. Further, referring to FIG. 4, the depth $A_1$ of annular grove 241*b* is required to be more than 0.15 mm in order to eliminate noise due to resonant vibration.

Figure 6:
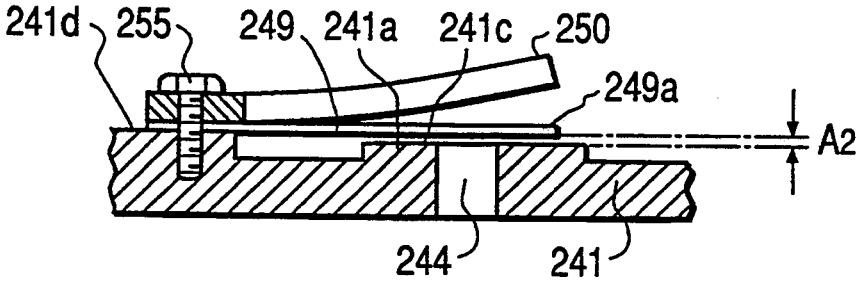
FIG. 6 is a sectional view of a discharge valve assembly in accordance with a second embodiment of the present invention.
Figure 7:
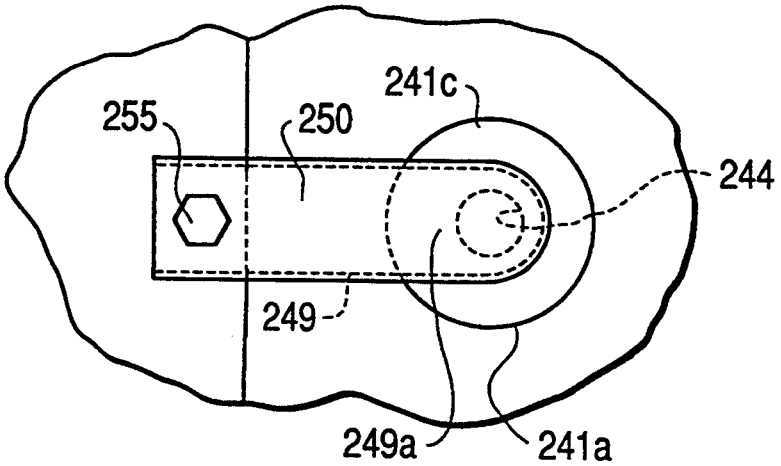
FIG. 7 is a plan view of the discharge valve assembly in accordance with the second embodiment of the present invention as depicted in FIG. 6.

FIGS. 6 and 7 illustrate a second embodiment of the present invention. Second circular end plate 241 divides axial end surface 241*c* and fixing surface 241*d* to which discharge reed valve 249 and valve retainer 250 are secured together. Fixing surface 241*d* is formed to be higher than axial end surface 241*c* so that air gap $A_2$ is created between the lower surface of discharge reed valve 249 and axial end surface 241*c*. Moreover, end portion 249*a* of discharge reed valve 249 may be designed to be axially offset so that air gap $A_2$ is created between the lower surface of discharge reed valve 249 and axial end surface 241*c*. The surface of discharge reed valve 249 that faces valve seat 241*a* is parallel to axial end surface 241*c* of valve seat 241*a*.

Figure 13:
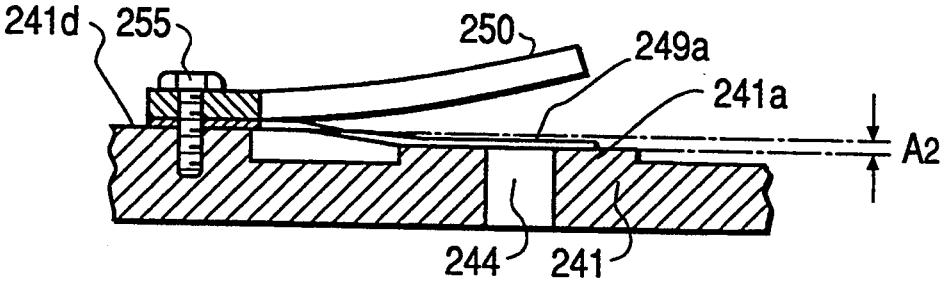
FIG. 13 is a detailed sectional view of the discharge valve assembly as depicted in FIG. 6.

When operation of compressor 1 is stopped, there is a predetermined air gap between discharge reed valve 249 and valve seat 241*a*. However, once operation of compressor 1 starts, a pressure in discharge chamber 27 is gradually increased and consequently becomes higher than an integrated pressure force which results from a pressure in compression chamber 245 added to a restoring force of discharge reed valve 249, as discharge reed valve 249 is opened and closed several times. After this staring period, discharge reed valve 249 becomes free from a condition where discharge reed valve 249 adheres to valve seat 241*a* as well as a condition where a predetermined air gap is not provided, as shown FIG. 13.

Figure 14:
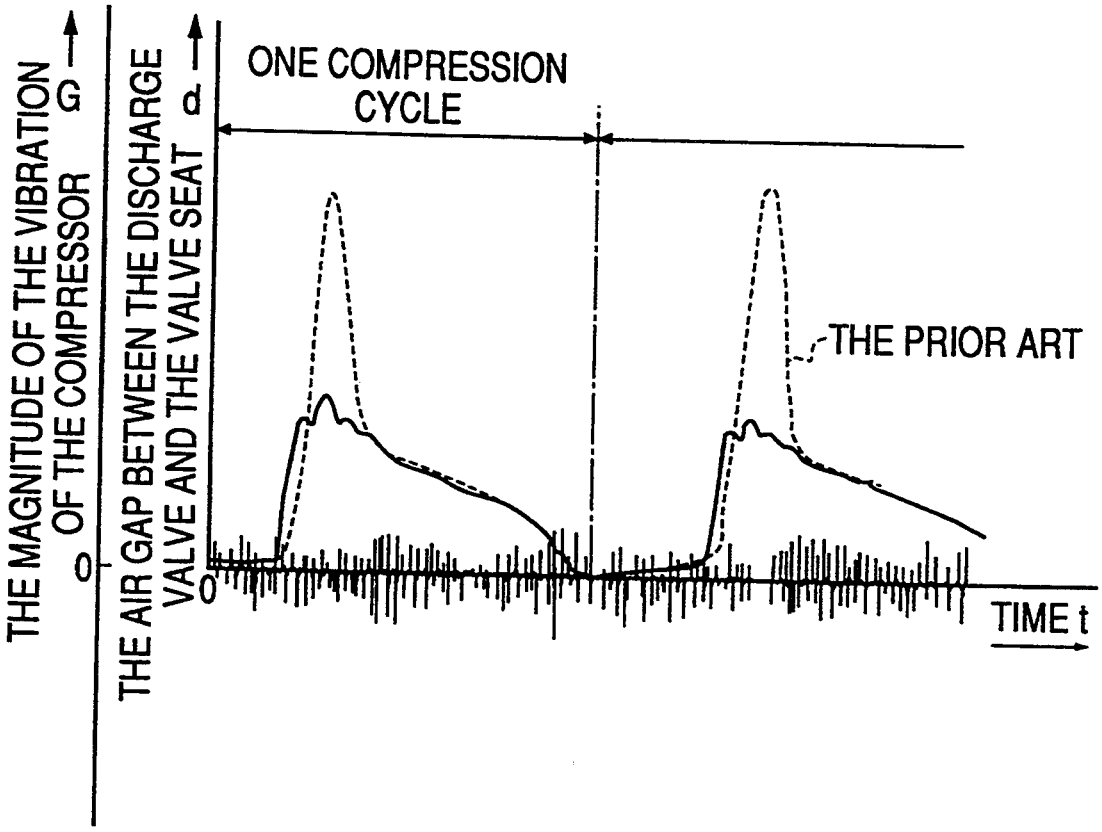
FIG. 14 is graphical illustration of the relationship between air gap $A_2$, as depicted in FIG. 6, and time t, and a graphical illustration of the relationship between magnitude G of a vibration of a compressor, in accordance with the second embodiment of the present invention, and time t.

Referring to FIG. 14, the movement locus of air gap d does not rise above the peak of the movement of discharge reed valve 249 in the prior art because the compressed refrigerant gas flows out from compression chamber 245 partially due to the lifting of discharge reed valve 249 by the restoring force of discharge reed valve 249. Thus, noise due to resonant vibration is not caused by the movement of discharge reed valve 249 because the movement of discharge reed valve 249 is beyond the scope of movement by which vibrational noise is caused. Further, the value of air gap d is required to be more than 0.15 mm in order to eliminate noise due to resonant vibration.

Figure 8:
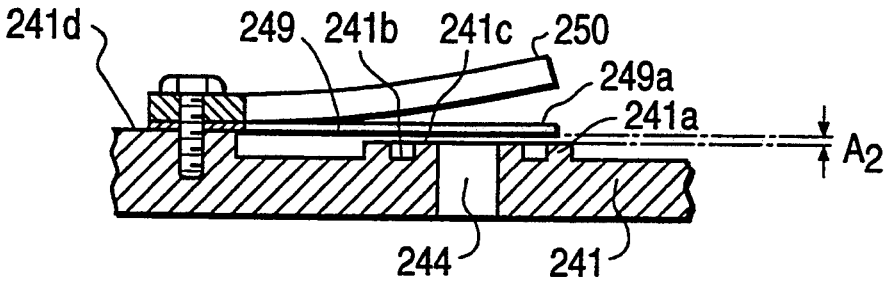
FIG. 8 is a sectional view of a discharge valve assembly in accordance with a third embodiment of the present invention.

FIG. 8 illustrates a third embodiment of the present invention. The third embodiment includes elements from both the first and second embodiments, i.e. annular groove 241*b*. Discharge reed valve 249 includes end portion 249*a* which is dimensioned to be larger than the outer diameter of annular groove 241*b* so as to entirely cover annular groove 241*b*. Fixing surface 241*d* is axially offset and higher than axial end surface 241*c*. Air gap $A_2$ is designed to be axially created between the lower surface of discharge reed valve 249 and axial end surface 241*c*. Therefore, this embodiment provides the advantages of both the first and second embodiments regarding reduction of noise due to resonant vibration.

Moreover, in the second and third embodiments, a life of discharge reed valve 249 is lengthened because discharge reed valve 249 softly contacts valve seat 241*a* due to the restoring force of discharge valve 249.

Although the present invention has been described in connection with the preferred embodiments, the invention is not limited thereto. It will be easily understood by those of ordinary skill in the art that variations and modifications can be easily made within the scope of this invention as defined by the following claims.

We claim:

1. A refrigerant compressor comprising:

a compressor housing divided at least partially by a valve plate into a first chamber and a second chamber, said second chamber comprising a discharge chamber;

linking means for linking said first chamber to said discharge chamber, said linking means including a conduit communicating said first chamber with said discharge chamber, said conduit having an end opening through which a refrigerant gas may exit said conduit;

a valve seat comprising a raised cylindrical extension extending from said valve plate and at least partially surrounding said end opening of said conduit, wherein an annular groove is formed in said valve seat at an end surface thereof;

an elastic valve member capable of bending to open and close said end opening of said conduit, said valve member having a predetermined spring constant such that said end opening of said conduit remains blocked until a pressure in said first chamber reaches a predetermined value;

limiting means for limiting the bending movement of said valve member in the direction in which said refrigerant gas exits said end opening of said conduit, said limiting means including a retainer member.

2. The refrigerant compressor of claim 1, wherein said annular groove is entirely overlaid by said valve member.

3. The refrigerant compressor of claim 1, wherein said valve member and said valve seat are spaced apart to form an air gap therebetween.

4. The refrigerant compressor of claim 1, wherein said annular groove at least partially surrounds said conduit.

5. The refrigerant compressor of claim 4, wherein said annular groove is concentric with said conduit.

6. The refrigerant compressor of claim 4, wherein said annular groove is entirely overlaid by said valve member.

7. The refrigerant compressor of claim 6, wherein said annular groove is concentric with said conduit.

8. A refrigerant compressor comprising:

a compressor housing divided at least partially by a valve plate into a first chamber and a second chamber, said second chamber comprising a discharge chamber;

linking means for linking said first chamber to said discharge chamber, said linking means including a conduit communicating said first chamber with said discharge chamber, said conduit having an end opening through which a refrigerant gas may exit said conduit;

a valve seat comprising a raised cylindrical extension extending from said valve plate and at least partially surrounding said end opening of said conduit, wherein an annular groove is formed in said valve seat at an end surface thereof, said annular groove having perpendicular side walls;

an elastic valve member capable of bending to open and close said end opening of said conduit, said valve member having a predetermined spring constant such that said end opening of said conduit remains blocked until a pressure in said first chamber reaches a predetermined value, wherein said valve member and said valve seat are spaced apart to form an air gap therebetween .

limiting means for limiting the bending movement of said valve member in the direction in which said refrigerant gas exits said end opening of said conduit, said limiting means including a retainer member.

9. The refrigerant compressor of claim 8, said valve member having an end surface facing an end surface of said valve plate, wherein said end surface of said valve member is parallel to said end surface of said valve plate.

10. A refrigerant compressor comprising:

a compressor housing;

a valve plate at least partially dividing said compressor housing into a first chamber and a second chamber, said second chamber having a discharge chamber;

linking means for linking said first chamber to said discharge chamber, said linking means including a conduit communicating said first chamber with said discharge chamber, said conduit having an end opening through which a refrigerant gas may exit said conduit;

a valve seat comprising a raised cylindrical extension extending from said valve plate and at least partially surrounding said end opening of said conduit;

an elastic valve member capable of bending to open and close said end opening of said conduit, said valve member having a predetermined spring constant such that said end opening remains closed until a pressure in said first chamber reaches a predetermined value;

limiting means for limiting the bending of said valve member in the direction in which said refrigerant gas exits said end opening of said conduit, said exiting refrigerant gas producing resonant vibration, said limiting means including a retainer member; and means for reducing the resonant vibration produced by said exiting refrigerant gas, said reducing means formed in said valve seat.

* * * * *